US012345506B2

(12) United States Patent
Pędzisz et al.

(10) Patent No.: US 12,345,506 B2
(45) Date of Patent: Jul. 1, 2025

(54) QUICK-UNFASTEN PROTECTIVE VEST, QUICK-RELEASE SYSTEM AND SNAP BUCKLE

(71) Applicants: Krzysztof Pędzisz, Warsaw (PL); Tomasz Teodorczuk, Józefosław (PL)

(72) Inventors: Krzysztof Pędzisz, Warsaw (PL); Tomasz Teodorczuk, Józefosław (PL)

( * ) Notice: Subject to any disclaimer, the term of this patent is extended or adjusted under 35 U.S.C. 154(b) by 0 days.

(21) Appl. No.: 18/686,077

(22) PCT Filed: Aug. 26, 2022

(86) PCT No.: PCT/PL2022/050052
§ 371 (c)(1),
(2) Date: Feb. 23, 2024

(87) PCT Pub. No.: WO2023/027605
PCT Pub. Date: Mar. 2, 2023

(65) Prior Publication Data

US 2024/0353203 A1 Oct. 24, 2024

(30) Foreign Application Priority Data

Aug. 26, 2021 (PL) ..... 438823

(51) Int. Cl.
*A44B 11/25* (2006.01)
*F41H 1/02* (2006.01)

(52) U.S. Cl.
CPC ..... *F41H 1/02* (2013.01); *A44B 11/2519* (2013.01)

(58) Field of Classification Search
CPC ..... F41H 1/02; A44B 11/2519; A44B 11/266; A44B 13/00; A41F 1/00
See application file for complete search history.

(56) References Cited

U.S. PATENT DOCUMENTS 4,150,464 A * 4/1979 Tracy ..... A44B 11/266 24/615
4,692,970 A * 9/1987 Anthony ..... A44B 11/2511 24/642

(Continued)

FOREIGN PATENT DOCUMENTS

EP 2198236 B1 1/2014
EP 2780656 B1 10/2016

(Continued)

OTHER PUBLICATIONS

International Search Report dated Nov. 23, 2022 in International Application No. PCT/PL2022/050052.

*Primary Examiner* — Robert H Muromoto, Jr.
(74) *Attorney, Agent, or Firm* — SALIWANCHIK, LLOYD & EISENSCHENK

(57) ABSTRACT

A quick-unfasten protective vest (1) including a quick-release system (2), a front body portion (3) and a rear body portion (4). The protective vest is characterised in that the front body portion (3) and the rear body portion (4) are detachably connected to each other by a quick-release system (2) including snap buckles (5) connected by ties (6) to a central release mechanism (7). A single tie (6) is guided from each snap buckle (5) to the central release mechanism (7) so that all ties (6) coincide in the central release mechanism (7). The central release mechanism (7) is adapted to release the snap buckles (5) substantially simultaneously and to separate the front body portion (3) from the rear body portion (4) of the vest (1).

13 Claims, 10 Drawing Sheets

(56) References Cited

U.S. PATENT DOCUMENTS 5,023,981 A * 6/1991 Anthony ..... A44B 11/2511 24/642
5,086,548 A * 2/1992 Tanaka ..... A44B 11/2549 24/579.11
5,131,122 A * 7/1992 Lavoto ..... A44B 11/266 24/616
5,438,737 A * 8/1995 Anscher ..... A44B 11/266 24/615
5,996,192 A * 12/1999 Haines ..... A44B 11/2549 24/615
6,393,677 B1 * 5/2002 Anscher ..... A44B 11/2549 24/615
7,497,034 B2 * 3/2009 Emerson ..... A63C 13/001 36/125
7,596,837 B1 * 10/2009 Tucker ..... A44B 11/2549 24/632
7,814,567 B2 * 10/2010 Dovner ..... F41H 1/02 2/2.5
8,196,273 B2 * 6/2012 Anscher ..... A44B 11/266 24/615
8,201,271 B2 * 6/2012 Dennis ..... F41H 1/02 2/310
8,464,407 B2 * 6/2013 Von Der Ahe ..... A44B 11/2519 24/648
8,479,312 B2 * 7/2013 Dovner ..... F41H 1/02 2/2.5
9,119,445 B2 * 9/2015 Humbert ..... A44B 11/2526
9,204,692 B2 * 12/2015 Lee ..... A44B 11/2592
9,562,746 B2 * 2/2017 Khandelwal ..... F41H 1/02
9,614,332 B2 * 4/2017 Curtin ..... H01R 13/665
11,564,459 B2 * 1/2023 Thompson ..... A44B 11/2553
2007/0163155 A1 * 7/2007 Emerson ..... A63C 13/006 36/122
2010/0313392 A1 * 12/2010 Anscher ..... A44B 11/266 24/616
2012/0030852 A1 * 2/2012 Anscher ..... F41H 1/02 2/102
2012/0297527 A1 * 11/2012 Darnell ..... A44B 11/266 2/455

FOREIGN PATENT DOCUMENTS

EP 3396298 A1 10/2018
PL 209300 B1 8/2011
TW 201924562 A 7/2019

* cited by examiner

[Fig. 1]
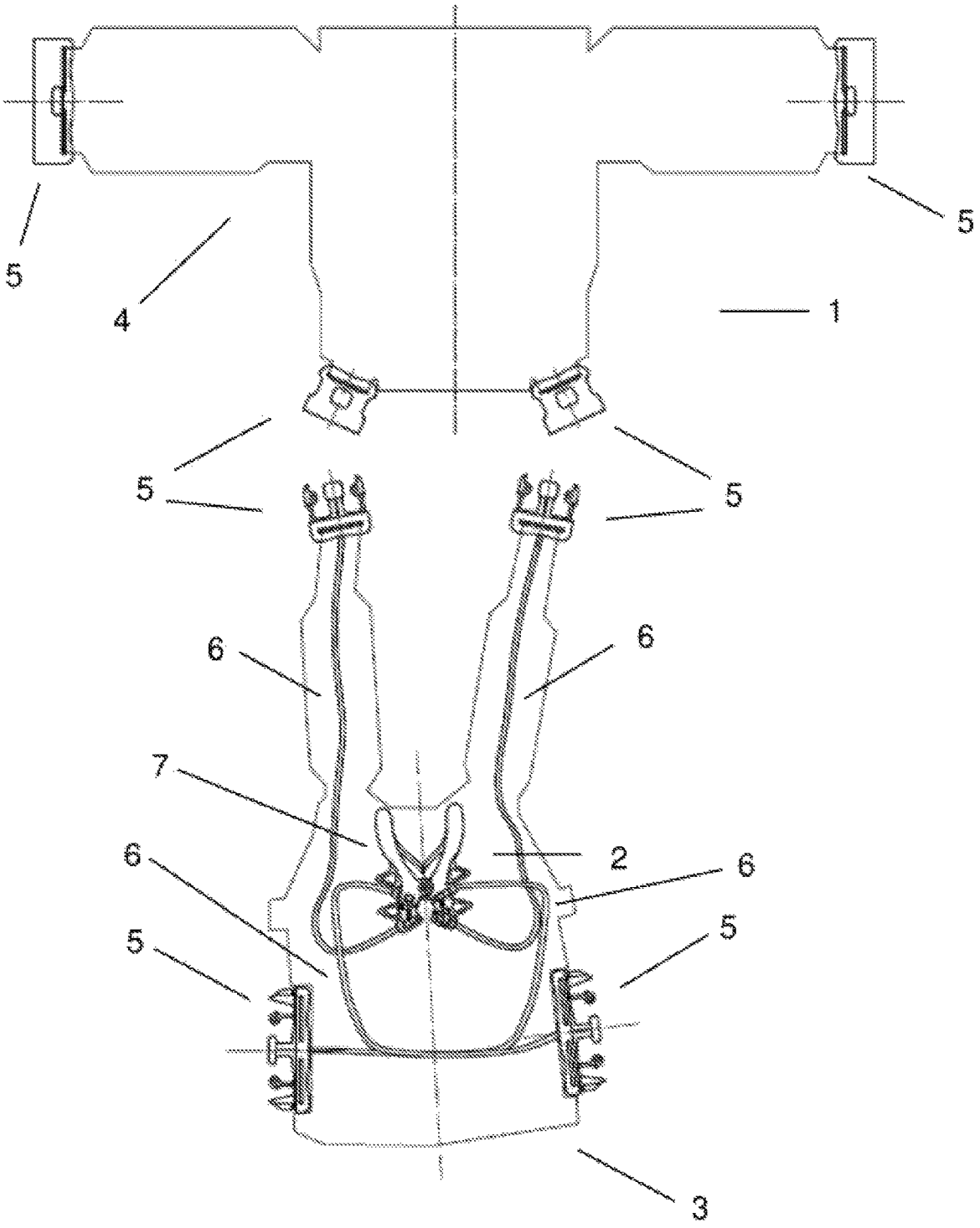

[Fig. 2]
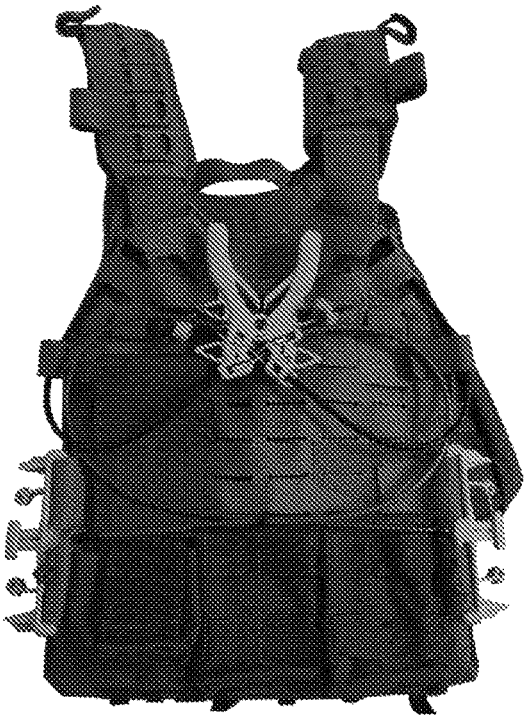
[Fig. 3A]
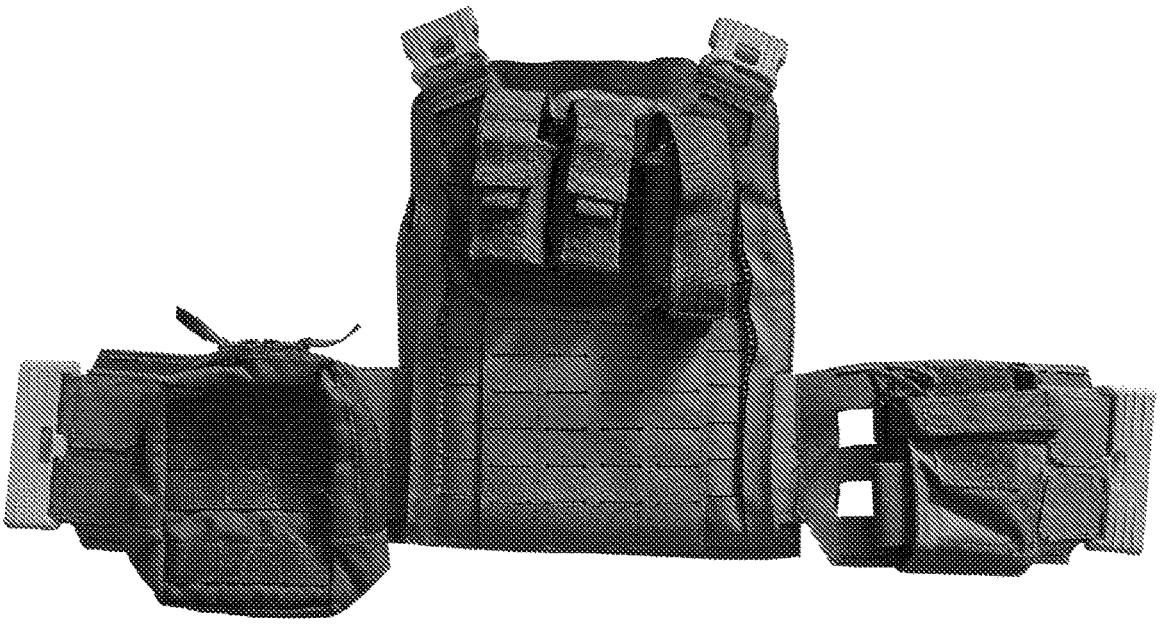

[Fig. 3B]
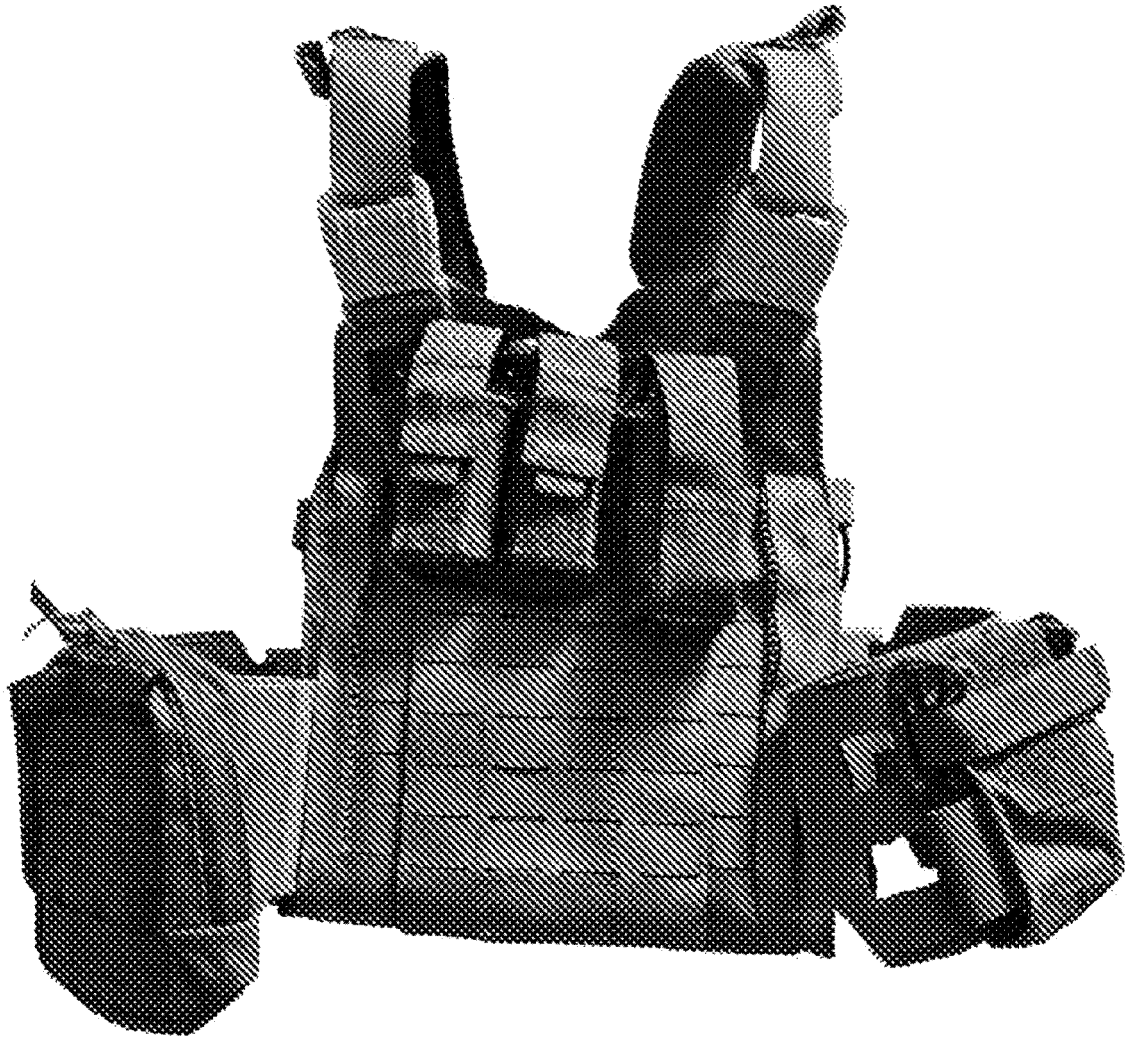

[Fig. 4A]
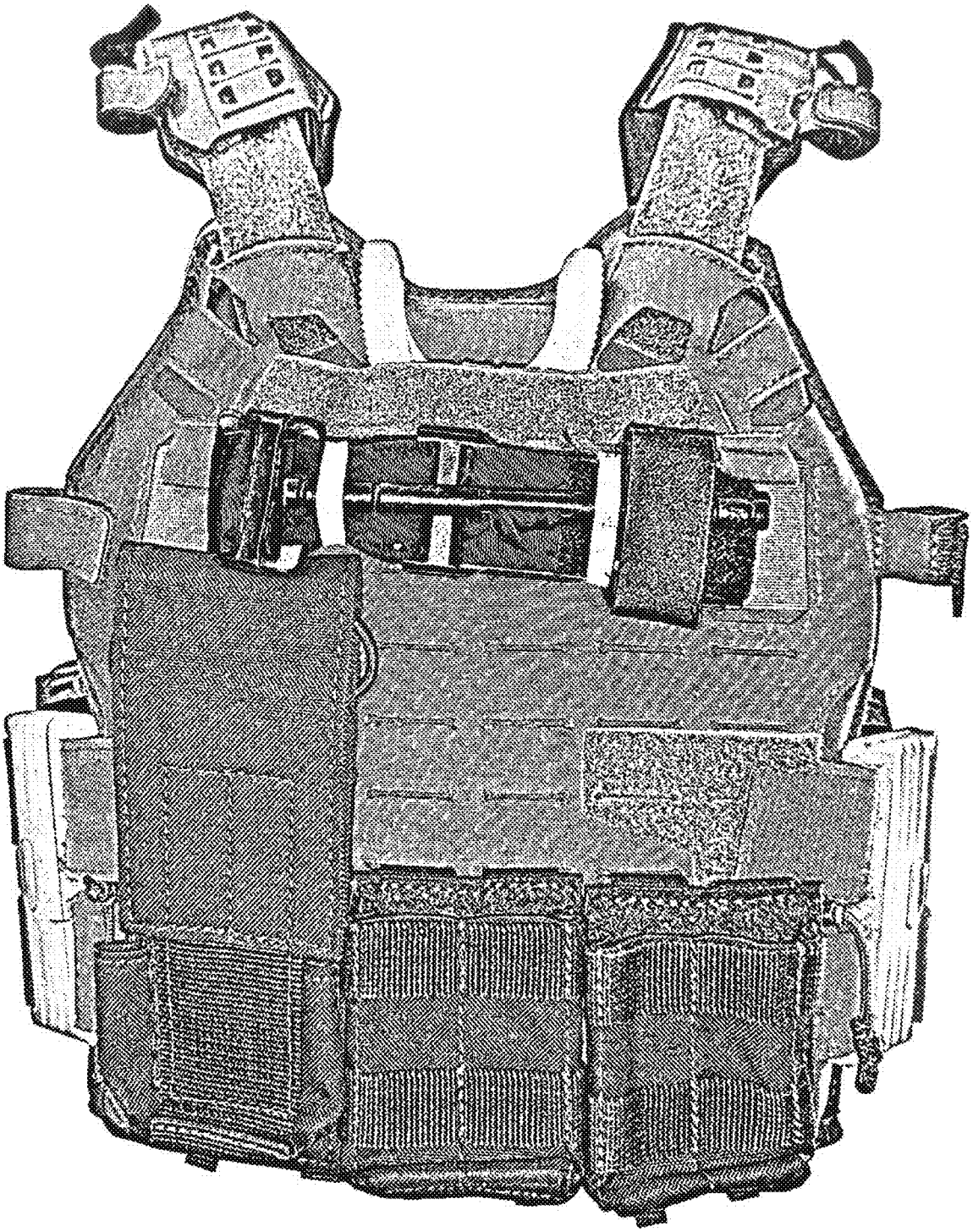

[Fig. 4B]
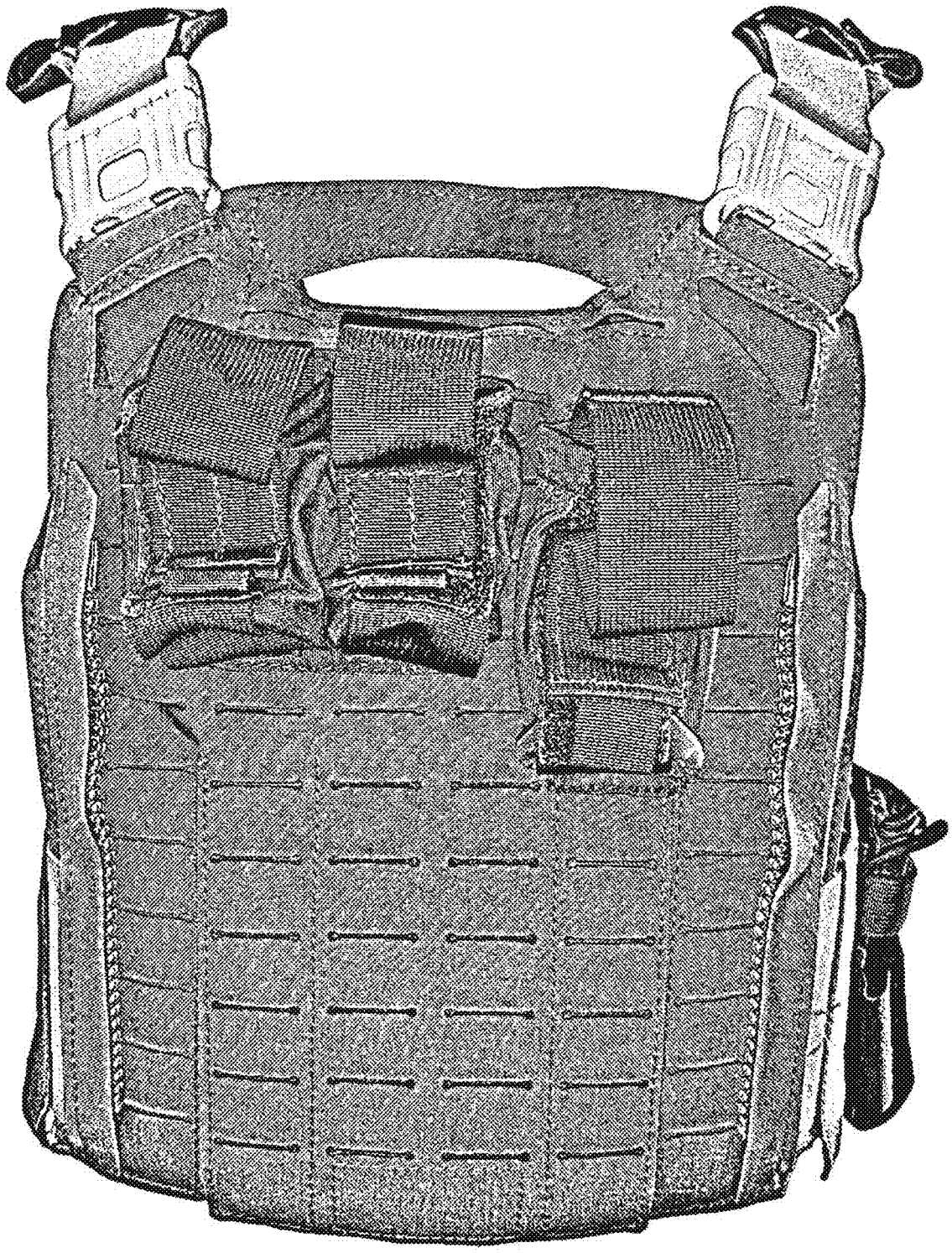

[Fig. 4C]
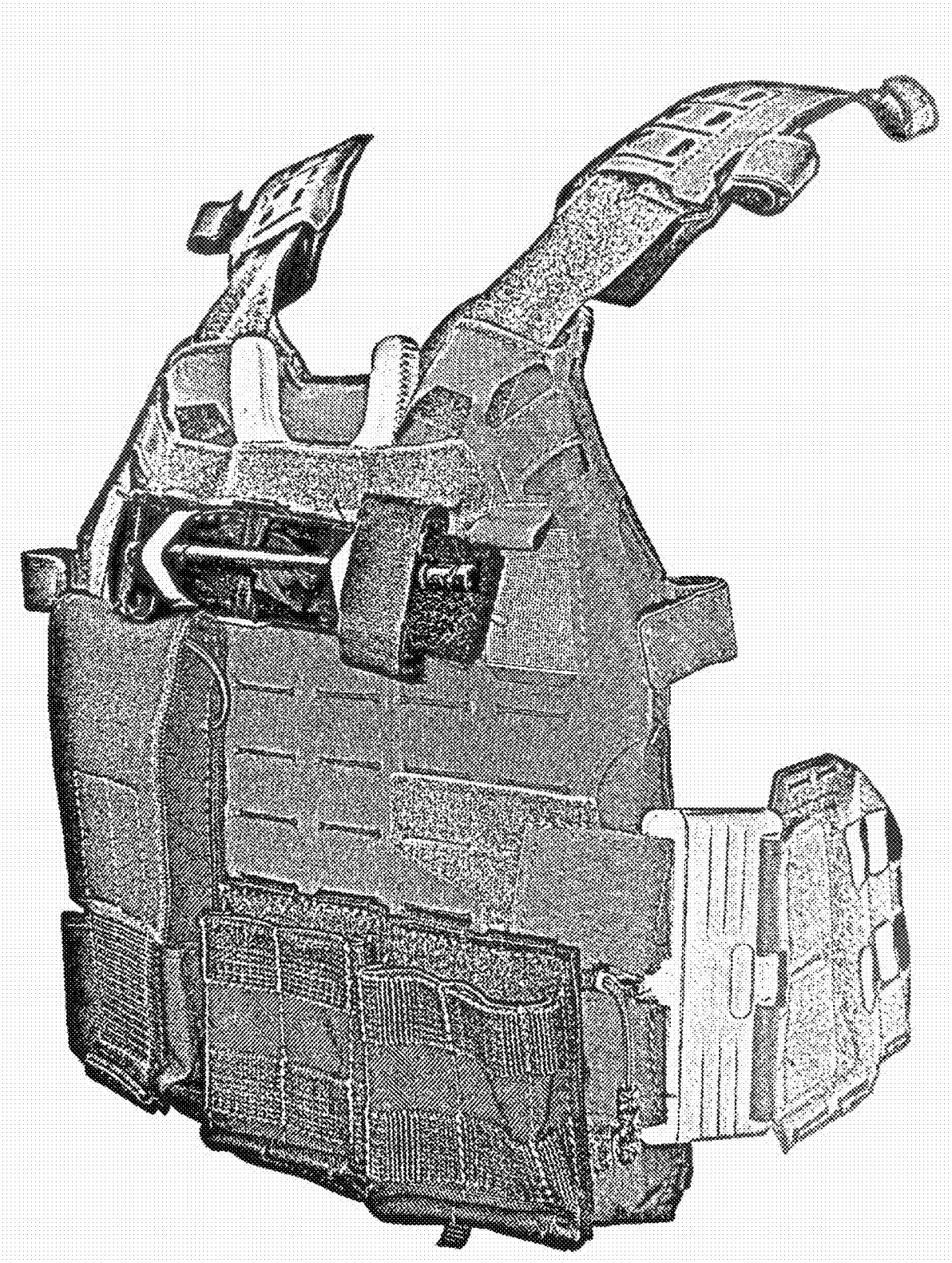

[Fig. 5]
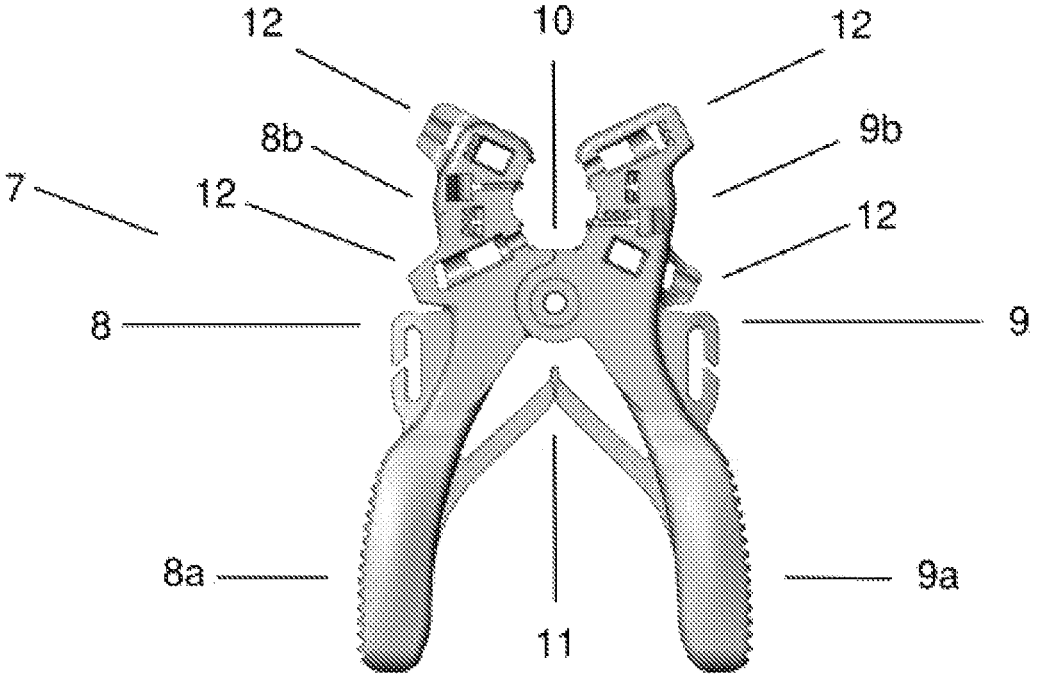
[Fig. 6A]
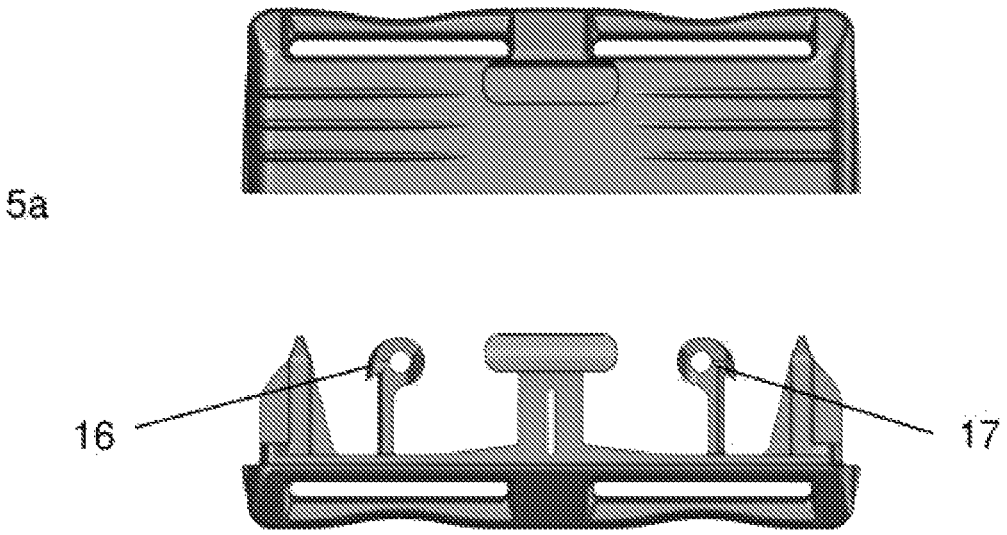

[Fig. 6B]
5a
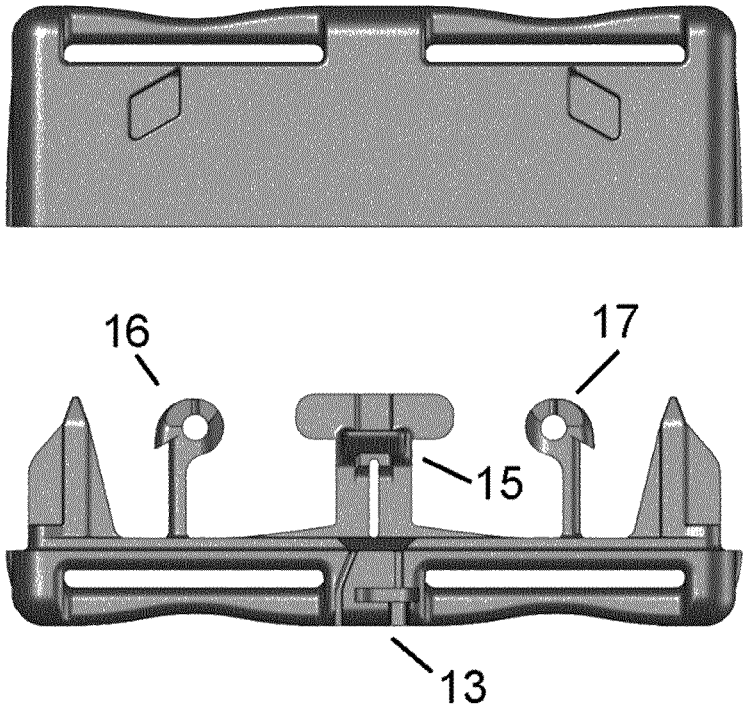
[Fig. 7]
5a
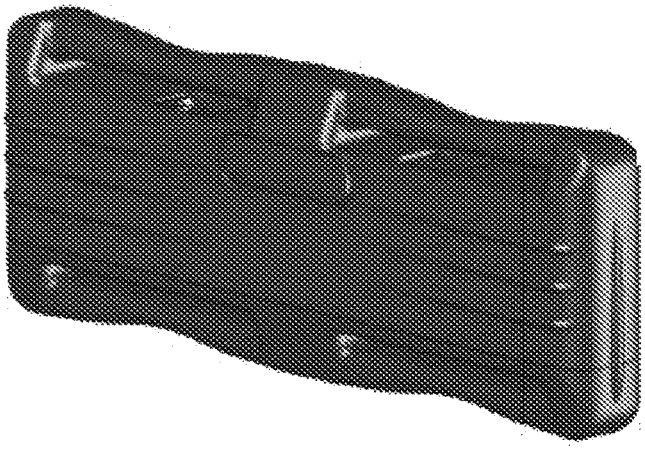

[Fig. 8A]
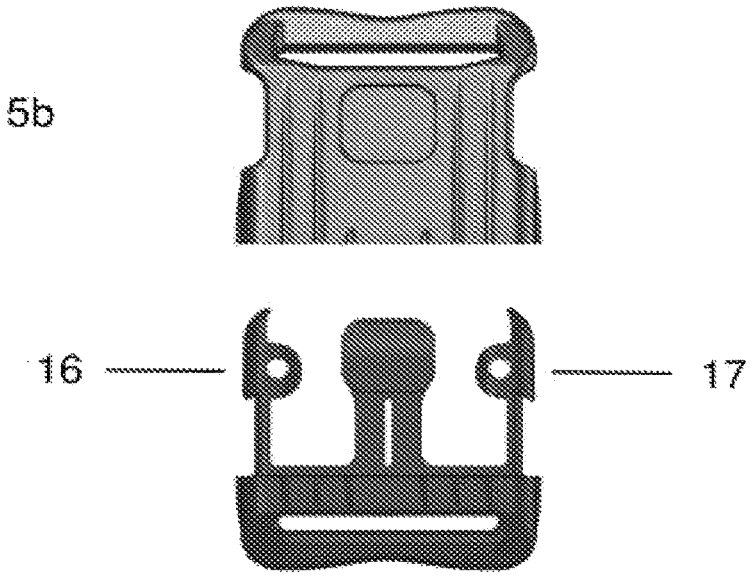
[Fig. 8B]
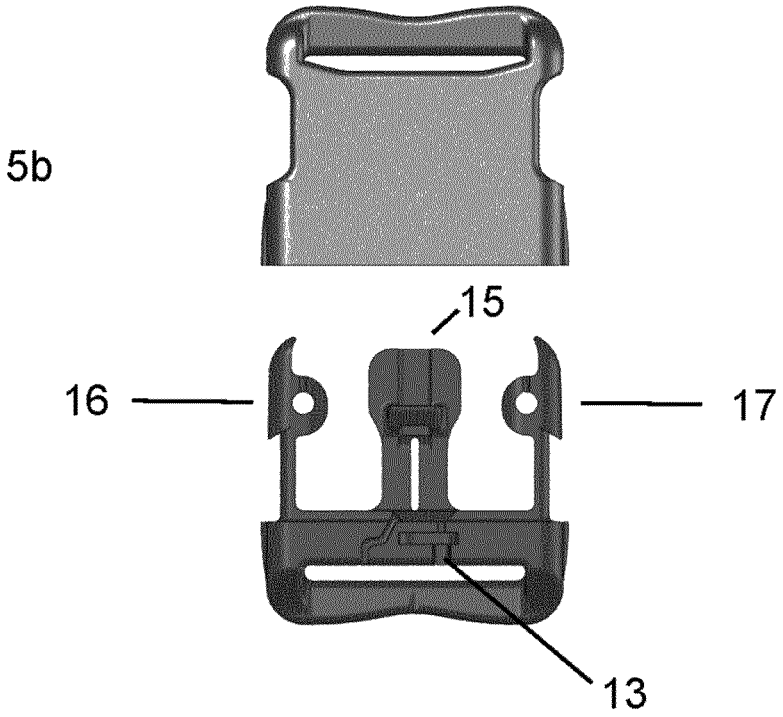

[Fig. 9]
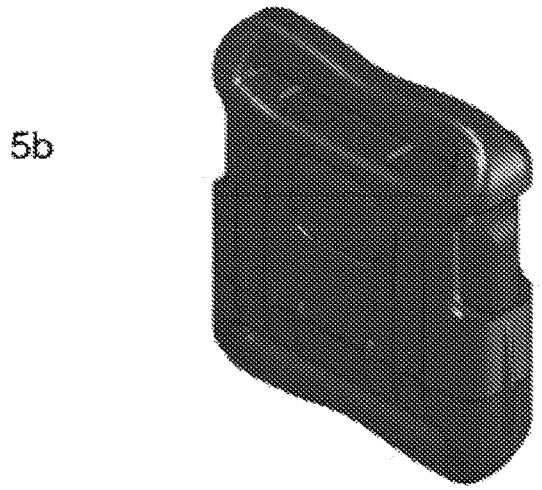
[Fig. 10]
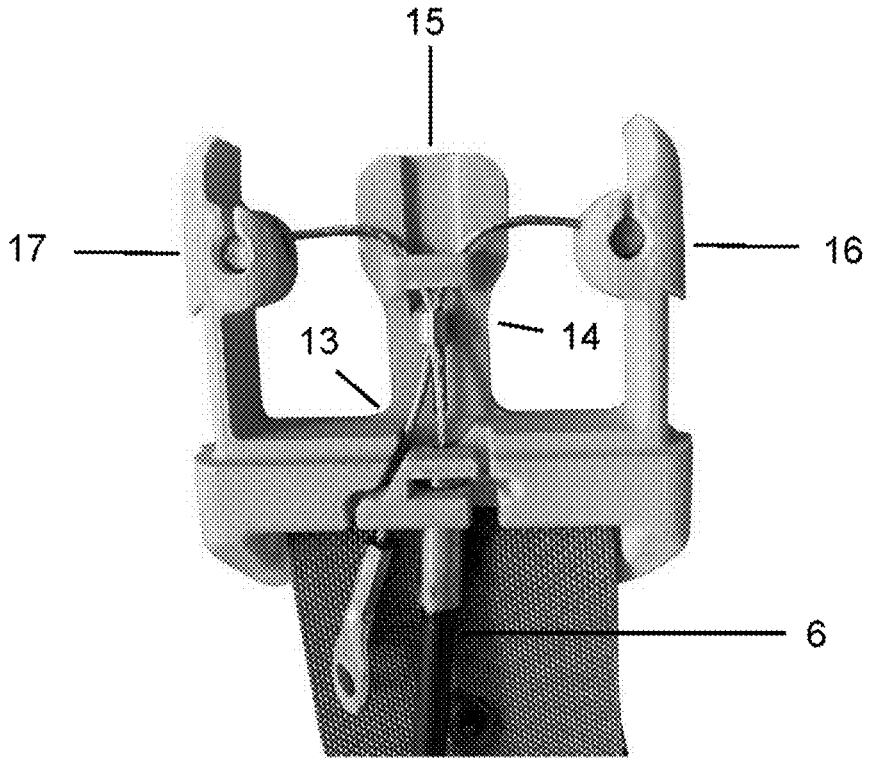

QUICK-UNFASTEN PROTECTIVE VEST, QUICK-RELEASE SYSTEM AND SNAP BUCKLE

CROSS-REFERENCE TO RELATED APPLICATIONS

This application is the U.S. national stage application of International Patent Application No. PCT/PL2022/050052, filed Aug. 26, 2022, which claims the benefit under 35 U.S.C. § 119 of Polish Application No. P.438823, filed Aug. 26, 2021, the disclosures of each of which are incorporated herein by reference in their entirety.

The present invention relates to a quick-unfasten protective vest comprising a quick-release system and a quick-release system for the protective vest. The present invention also relates to a snap buckle adapted for quick release, in particular for a quick-release system.

TECHNICAL FIELD

Protective vests used in military, police, security and similar operations cover the torso of the wearer to protect them from the effects of unwanted impacts, such as bullets fired from firearms or blows delivered by edged weapons. These types of vests include i.a. bulletproof vests. Typically, these are constructed with a front and rear (back) section, which are fastened at the shoulders and sides with self-locking tapes. Putting on or taking off such a vest requires the individual tapes to be fastened or unfastened independently each time.

In the event of an emergency situations, the protective vest should be quickly removed from the wearer. For example, when a wearer wearing a protective vest is injured and requires immediate medical attention, there is a need to remove it from the wearer as quickly as possible. Similarly, when a wearer finds themselves in the water, quick release from a heavy vest can determine the health and life of the wearer. Quick removal of the vest may also be advisable when the wearer is changing clothes or instrumentation in the field of their operation.

BACKGROUND ART

Protective vests comprising systems and mechanisms for quick release and the mechanisms designed for this purpose are known in the art.

EP 2 780 656 discloses a mechanism for attaching and releasing a garment such as a ballistic vest. The mechanism comprises a female C-shaped clip defining an open channel into which an elongated male pin is slidingly inserted, allowing the garment's components to be releasably attached. The female element and the male element are attached to the garment using normal fastenings, such as tape. The elements of the mechanism can be located, for example, on both shoulders and on both sides of the hips. The elements are released separately and independently of each other.

EP 3 396 298 discloses a rapid release device for wearable articles (e.g. bulletproof vests). Such a device may be located on the shoulder straps of the vest which allows a rapid removal of the vest without having to remove it from the head. The disclosed device comprises two substantially identical bodies having a coupling portion. Interlocking elements and recesses are present in the bodies, which move relative to each other to determine the state of (un)coupling. Each device is released separately and independently of each other.

Furthermore, solutions are known in the state of the art to ensure that the connecting elements of the protective garments can be released simultaneously. PL 209 300 discloses a method for mounting and dismounting load-carrying elements together with a structure designed therefor. The structure contains a fastening buckle located on the load-carrying element with permanently attached ties and strapping elements. The strapping elements work with double-assembled and cross-braced straps that form through-tunnel openings. The straps are threaded through the strapping elements and each tie is guided into the fastening buckle to its associated strapping point and threaded through the through-tunnel opening of the strap at a point behind the strapping element. Dismounting consists in separating the fastening buckle from the load-carrying element and pulling all the ties out of all the attachment points by pulling on the handle of the buckle.

EP 2 198 236 discloses a quickly releasable protective vest comprising a plurality of plug members of the eye hook-tongue type connecting the individual vest components. Each plug member comprises a pair of connecting wires connecting the eye hook to the tongue. The pair of connecting wires are further connected to a strap attached to the plug member, after which all the straps connect at the central section of the vest to form a release mechanism together with a pull cord.

U.S. Pat. No. 7,814,567 discloses a protective garment such as a protective vest having a quick release system. The system includes ring elements with shackle-type hook elements inserted therein. These elements are attached to each other by means of a pull cord capable of disengaging the system by means of simultaneous release of the hooks, thereby disassembling the garment into components.

U.S. Pat. No. 8,479,312 discloses a protective garment, e.g. a tactical ballistic vest, comprising a quick-release system designed to disassemble the protective garment into components. The garment components are detachably connected to each other by straps and several shackles located near the front portion at a waist area. The disclosed mechanism allows the shackles to be opened by pulling the cord leading to either substantially simultaneous or independent release of the individual components of the protective garment and thus to its removal from the wearer.

SUMMARY OF INVENTION

Limitations of the existing solutions involve the necessity to spend a lot of time removing the protective vest, due to the large number of fasteners and the significant weight of the equipment. In addition, the prior art solutions are based on systems using pull cords in which there is a significant risk of unintentional pulling under normal conditions of use and thus removal of the protective vest from the wearer's body.

Thus, it is an purpose of the invention to provide a quick-unfasten protective vest comprising a quick-release system, which overcomes the limitations indicated. A further purpose of the invention is to provide a quick-unfasten protective vest comprising a quick-release system, which is simultaneously suitable for easy and quick removal, i.e. separation from the wearer's body, and, subsequently, for quick reassembly to the initial state and putting on the wearer's body. A further purpose of the invention is to provide a quick-release system capable of fulfilling the above-mentioned purposes, in particular capable of simultaneously and quickly releasing all the snap buckles present in the system and, subsequently, of quickly reassembling to the initial state.

A further purpose of the invention is to provide a snap buckle allowing the quick and simultaneous release of all the snap points present therein. The use of the technical elements disclosed herein, their combination and their connection makes it possible to achieve the preferable purpose of the invention.

The above problems are solved by the present invention. The present invention is a quick-unfasten protective vest comprising a quick-release system, a front body portion and a rear body portion characterised in that the front body portion and the rear body portion are detachably connected to each other by a quick-release system comprising snap buckles connected by ties to a central release mechanism, wherein a single tie is guided from each snap buckle to the central release mechanism such that all ties coincide in the central release mechanism and the central release mechanism is adapted to release the snap buckles substantially simultaneously and to separate the front body portion from the rear body portion of the vest.

Preferably, disclosed herein is a quick-unfasten protective vest according to the invention characterised in that the central release mechanism consists of two parts connected to each other and forming a tie-compression mechanism, wherein said first part comprises one operating part and one handle and said second part comprises one operating part and one handle, with a squeeze opening element between the handles, which is adapted to fix the initial position of said two parts and to compress and release them with the snap buckles in the operating position, the operating parts being oppositely arranged and each operating part comprises two tie sockets, the tie sockets being arranged so that the tie socket releasing the first shoulder buckle is opposite the tie socket releasing the second shoulder buckle and obliquely from the tie socket releasing the first hip buckle.

Preferably, disclosed herein is a quick-unfasten protective vest according to the invention characterised in that the central release mechanism is adapted to substantially simultaneously release all snap buckles.

Preferably, disclosed herein is a quick-unfasten protective vest according to the invention characterised in that the central release mechanism is located in the front body portion between its centre and the body upper edge.

Preferably, disclosed herein is a quick-unfasten protective vest according to the invention characterised in that the central release mechanism is from a material selected from plastic, metal or composite.

Preferably, disclosed herein is a quick-unfasten protective vest according to the invention characterised in that said parts are identical and symmetrically aligned with respect to each other.

Preferably, disclosed herein is a quick-unfasten protective vest according to the invention characterised in that the quick-release system comprises four snap buckles, including two hip buckles and two shoulder buckles.

Preferably, disclosed herein is a quick-unfasten protective vest according to the invention characterised in that the quick-release system is concealed under the top layer of the front body portion of the protective vest.

Preferably, disclosed herein is a quick-unfasten protective vest according to the invention characterised in that the snap buckles are three-point buckles and comprise a male part and a female part that are detachably connected.

Preferably, disclosed herein is a quick-unfasten protective vest according to the invention characterised in that the snap buckles are from a material selected from plastic or composite.

Preferably, disclosed herein is a quick-unfasten protective vest according to the invention characterised in that the number of ties corresponds to the number of snap buckles.

Preferably, disclosed herein is a quick-unfasten protective vest according to the invention characterised in that the ties are from a material selected from plastic, metal or composite.

Preferably, disclosed herein is a quick-unfasten protective vest according to the invention characterised in that the ties are contained in a protective armour made of a material selected from plastic, metal or composite.

Disclosed herein is also a quick-release system characterised in that it comprises snap buckles connected by ties to a central release mechanism, a single tie being guided from each snap buckle to the central release mechanism such that all ties coincide in the central release mechanism and the central release mechanism is adapted to release the snap buckles substantially simultaneously.

Preferably, disclosed herein is a quick-release system according to the invention characterised in that the central release mechanism consists of two parts connected to each other and forming a tie-compression mechanism, wherein said first part comprises one operating part and one handle and said second part comprises one operating part and one handle, with a squeeze opening element between the handles, which is adapted to fix the initial position of said two parts and to compress and release them with the snap buckles in the operating position, the operating parts being oppositely arranged and each operating part comprises two tie sockets, the tie sockets being arranged so that the tie socket releasing the first shoulder buckle is opposite the tie socket releasing the second shoulder buckle and obliquely from the tie socket releasing the first hip buckle.

Preferably, disclosed herein is a quick-release system according to the invention characterised in that the central release mechanism is adapted to release substantially simultaneously all the snap buckles.

Preferably, disclosed herein is a quick-release system according to the invention characterised in that the central release mechanism is located in the front body portion of the protective vest between its centre and the body upper edge.

Preferably, disclosed herein is a quick-release system according to the invention characterised in that the central release mechanism is from a material selected from plastic, metal or composite.

Preferably, disclosed herein is a quick-release system according to the invention characterised in that said parts are identical and symmetrically aligned with respect to each other.

Preferably, the object is a quick-release system according to the invention characterised in that it comprises four snap buckles, including two hip buckles and two shoulder buckles.

Preferably, disclosed herein is a quick-release system according to the invention characterised in that the quick-release system is concealed under the top layer of the front body portion of the protective vest.

Preferably, disclosed herein is a quick-release system according to the invention characterised in that the snap buckles are three-point buckles and comprise a male part and a female part detachably connected.

Preferably, disclosed herein is a quick-release system according to the invention characterised in that the snap buckles are from a material selected from plastic or composite.

Preferably, disclosed herein is a quick-release system according to the invention characterised in that the number of ties corresponds to the number of snap buckles.

Preferably, disclosed herein is a quick-release system according to the invention characterised in that the ties are from a material selected from plastic, metal or composite.

Preferably, disclosed herein is a quick-release system according to the invention characterised in that the ties are contained in a protective armour made of a material selected from plastic, metal or composite.

Disclosed herein is also a snap buckle comprising a male part and a female part detachably connected by three snap points, characterised in that the male part comprises the snap points and all the snap points are connected to each other by a tie, the tie running through an attachment recess of the male part of the buckle, behind the recess the tie is connected at the attachment point with a second tie so that the two ends of the ties run through the central snap point to the lateral snap points, so that one end of one tie runs to one lateral snap point and one end of the second tie runs to the other lateral snap point, and the release movement of the tie is adapted to release all the snap points substantially simultaneously.

BRIEF DESCRIPTION OF DRAWINGS

The present invention in its embodiments is illustrated in the drawing, in which:

FIG. 1

[FIG. 1] shows a schematic diagram of an embodiment of a quick-unfasten protective vest according to the invention (front portion and rear portion) with a quick-release system according to the invention marked in its disassembled version.

FIG. 2

[FIG. 2] shows a view of an embodiment of the quick-unfasten protective vest according to the invention, with the quick-release system according to the invention visible (the front portion of the vest is shown).

FIG. 3

[FIG. 3] shows a view of an embodiment of the quick-unfasten protective vest according to the invention with the quick-release system according to the invention fitted in it, in the version of the vest in the state of disassembled ([FIG. 3A]) and assembled ([FIG. 3B]) (the front portions is shown).

FIG. 4

[FIG. 4] shows a view of an embodiment of the quick-unfasten protective vest according to the invention with the quick-release system according to the invention worn on the wearer: [FIG. 4A] shows a front view, [FIG. 4B] shows a rear view, [FIG. 4C] shows a side view.

FIG. 5

[FIG. 5] shows a view of an embodiment of a central release mechanism of the quick-release system according to the invention.

FIG. 6

[FIG. 6] shows a view of an embodiment of the hip snap buckle according to the invention of the quick-release system according to the invention in the disassembled state; [FIG. 6A] shows the front side (distal from the wearer's body), while [FIG. 6B] shows the back side (proximal to the wearer's body).

FIG. 7

[FIG. 7] shows a view of an embodiment of the hip snap buckle according to the invention of the quick-release system according to the invention in the assembled state (the front side is shown).

FIG. 8

[FIG. 8] shows a view of an embodiment of the shoulder snap buckle according to the invention of the quick-release system according to the invention in the disassembled state; [FIG. 8A] shows the front side (distal from the wearer's body), while [FIG. 8B] shows the back side (proximal to the wearer's body).

FIG. 9

[FIG. 9] shows a view of an embodiment of the shoulder snap buckle according to the invention of the quick-release system according to the invention in the assembled state (the front side is shown).

FIG. 10

[FIG. 10] shows a view of the male part of an embodiment of the shoulder snap buckle according to the invention of the quick-release system according to the invention in the disassembled state (the rear side is shown) together with the course and attachments of the tie.

DESCRIPTION OF EMBODIMENTS

Only details necessary for understanding the invention are shown in the figures. Constructions and details that are not necessary for understanding the invention, but are obvious a person skilled in the art, have been omitted from the figures in order to highlight only the characteristic features of the invention.

A protective vest according to the invention is understood to be a tactical vest with or without protective inserts to protect the wearer from the effects of unwanted impacts, e.g. from bullets fired from a firearm or from blows delivered by an edged weapon. In such a case, the tactical vest is referred to as a bulletproof tactical vest.

In one embodiment, a quick-unfasten protective vest according to the invention, together with reference numerals to the individual components, is shown in [FIG. 1], where:

1 refers to a quick-unfasten protective vest,
2 refers to a quick-release system,
3 refers to a front body portion,
4 refers to a rear body portion,
5 refers to snap buckles,
6 refers to ties,
7 refers to a central release mechanism.

The quick-unfasten protective vest contains a quick-release system 2, a front body portion 3 and a rear body portion 4.

The quick-release system 2 connects detachably the front body portion 3 and the body rear portion 4. The quick-release system 2 comprises snap buckles 5 connected by ties 6 to the central release mechanism 7. In the quick-release system according to the invention, a single tie 6 is guided from each snap buckle 5 present in the release system according to the invention to the central release mechanism 7. The guiding of the ties takes place so that all ties 6 coincide the central release mechanism 7.

The central release mechanism 7 is located in the front body portion 3 of the vest according to the invention between its centre and the body upper edge. Its location is such that the handle 8*b* and the handle 9*b* are visible, i.e. protrude from the surface layer of the front body portion 3 of the vest according to the invention. Thus, they are ready to press and release the snap buckles.

In one embodiment, the quick-release system according to the invention preferably comprises four snap buckles 5, including two hip buckles 5*a* and two shoulder buckles 5*b*. However, the number of snap buckles 5 in the quick-release system 2 may be arbitrary and adapted to the respective applications. A person skilled in the art will be able to adapt the appropriate number of snap buckles 5 to the respective application.

Hip snap buckles 5*a* connect the hip parts (bottom) of the front portion and the rear portion of the vest according to the invention by means of a hip belt.

Shoulder snap buckles 5*b* connect the shoulder parts (top) of the front portion and the rear portion of the vest according to the invention.

[FIG. 2] shows a protective vest according to the invention with a visible quick-release system 2. [FIG. 2] shows the arrangement of the course of the ties 6 and their connection to the snap buckles 5. The number of ties 6 corresponds to the number of snap buckles 5. In one embodiment, the quick-release system according to the invention preferably comprises four ties 6 and four snap buckles 5.

Ties 6 are made of a material selected from plastic, metal or composite. In one embodiment, the ties are preferably made of steel.

The ties 6 can be coated with protective armour or be uncoated. Preferably, the ties are coated with protective armour.

[FIG. 3A] and [FIG. 3B] show the protective vest according to the invention together with the quick-release system fitted therein. [FIG. 3A] and [FIG. 3B] show the quick-release system concealed under the top layer of the front body portion 3 of the protective vest according to the invention. This means that the quick-release system according to the invention is substantially invisible to the wearer and third parties. Only the handles 8*b* and 9*b* of the central release mechanism 7 are visible, as discussed above.

Assembling the vest and preparing it for use by the wearer involves fastening all the snap buckles 5 as shown in [FIG. 3B]. [FIG. 4] shows the vest according to the invention thus assembled on the wearer and ready for its quick drop using the claimed solution.

[FIG. 5] shows the central release mechanism 7 of the quick-release system according to the invention. The central release mechanism 7 consists of two parts 8, 9 connected to each other and forming a tie-compression mechanism 10. By a tie-compression mechanism 10 is meant an arrangement of two identical parts 8 and 9 oppositely connected to form a turnbuckle pliers. The tie-compression mechanism 10 thus operates in such a way that, when the handles 8*a* and 9*a* are pressed together by a force F through an assembly-rotation point (not indicated in the drawing), the operating parts 8*b* and 9*b* counter-rotate according to the assembly-rotation point, increasing the distance between the sockets 12, which has the effect of pulling the tie(s) together, releasing the buckle(s).

Part 8 and part 9 act like pliers, so they can be opened and closed, causing a compression movement of the ties. Part 8 and part 9 are identical and symmetrically aligned to each other.

Part 8 comprises one operating part 8*b* (part upper segment 8) and one handle 8*a* (part lower segment 8). Part 9 comprises one operating part 9*b* (part upper segment 9) and one handle 9*a* (part lower segment 9). Between the handles 8*a*, 9*a* there is a squeeze opening element 11. The squeeze opening element 11 is adapted to fix the initial position of the parts 8, 9. Squeezing the parts 8,9 by bringing them closer to each other leads to the release of the snap buckles 5—this is the operating position of the invention.

The operating parts 8*b*, 9*b* are oppositely arranged. Each operating part 8*b*, 9*b* contains two sockets 12 for attaching ties 6.

In one embodiment, the tie sockets are arranged so that the tie socket releasing the first shoulder buckle 5*b* is located opposite the tie socket releasing the second shoulder buckle 5*b* and obliquely from the tie socket releasing the first hip buckle 5*a*.

The central release mechanism 7 is adapted to substantially simultaneously release the snap buckles 5 and to separate the front body portion 3 from the rear body portion 4 of the vest according to the invention. This causes the vest to be dropped from the wearer.

In one embodiment, the central release mechanism 7 is preferably adapted for substantially simultaneous release of all the snap buckles 5. By substantially simultaneous release of the snap buckles 5 it is meant that the buckles are released at the same time or at time intervals that are not substantially different, thus ensuring the correct drop of the protective vest according to the invention.

In another embodiment, the central release mechanism 7 is adapted to release each snap buckle 5 separately.

The central release mechanism 7 is from a material selected from plastic, metal or composite. In one embodiment, the preferable material of the central release mechanism 7 is plastic.

[FIG. 6] and [FIG. 7] show a view of an embodiment of the hip buckle 5*a* of the quick-release system according to the invention in the disassembled state ([FIG. 6]) and in the assembled state ([FIG. 7]). The hip buckle 5*a* comprises a male part and a female part detachably connected. The male part has an attachment recess 13 for the tie and snap points 15, 16, 17. Hip buckle 5*a* is thus a three-point buckle having three attachment points connected by a tie. The release movement of the tie 6 releases all the snap points substantially simultaneously.

[FIG. 8] and [FIG. 9] show a view of an embodiment of the shoulder buckle 5*b* of the quick-release system according to the invention in the disassembled state ([FIG. 8]) and in the assembled state ([FIG. 9]). The shoulder buckle 5*b* consists of a male part and a female part detachably connected. The male part has an attachment recess 13 for the tie and snap points 15, 16, 17. Shoulder buckle 5*b* is thus a three-point buckle having three attachment points connected by a tie.

[FIG. 10] shows a view of the male part of an embodiment of the shoulder snap buckle of the quick-release system according to the invention. The male part has an attachment recess 13 for the tie and snap points 15, 16, 17.

In a snap buckle according to the invention, e.g. a hip buckle or a shoulder buckle, the male part comprises snap points connected to each other by a tie. The tie 6 runs through the attachment recess 13 of the male part of the buckle 5. Behind the attachment recess 13, the tie is permanently connected to a second tie at the attachment point 14. At the attachment point 14, the ties are connected so that the two ends of the ties run through the central snap point 15 to the lateral snap points 16, 17. One end of one tie runs to one lateral snap point 16, and one end of the other tie runs to the other lateral snap point 17. This design of the snap buckle causes the release movement of tie 6, by pulling it through the central release mechanism, to release all of the snap points substantially simultaneously. This causes the male part and the female part of the snap buckle according to the invention to be disconnected.

The snap buckles 5 are constructed from a material selected from plastic or composite. In one embodiment, the preferable material of the snap buckles 5 is plastic.

The method of operation of the protective vest according to the invention together with the quick-release system according to the invention and the snap buckle according to the invention is as follows. The wearer, acting on the handle of the central release mechanism 7 by squeezing it, exerts pressure on the squeeze opening element 11 and causes movement of the ties 6 connected to the central release mechanism 7 at the first ends of the ties 6 and of the snap buckles 5 at the second ends of the ties 6. As a result, the snap points in the snap buckles 5 are released and the buckles are disconnected. In an preferable embodiment, there is a simultaneous release of all four snap buckles 5 and a simultaneous release of each of the three snap points in each individual snap buckle 5. This leads to a separation of the front portion of the vest body 3 and the rear portion of the vest body 4. Consequently, a drop of the vest according to the invention occurs. The compression movement involves only one hand of the wearer.

After separating the front portion 3 and the rear portion 4 of the vest, the buckles can be reconnected to each other and thus fasten both portions. The vest according to the invention can be reassembled in a short time and is reusable. The protective vest and the quick-release system according to the invention are thus a reusable solution.

In an embodiment, the protective vest according to the invention is a bulletproof tactical vest, i.e. a tactical vest comprising inserts to protect against the effects of unwanted impacts.

INDUSTRIAL APPLICABILITY

The use of three-point snap buckles inhibits the system from accidentally coming unfastened. This is also influenced by the fact that the quick-release system is concealed and invisible from the outside, so that the ties cannot be easily broken. This makes the invention a simple and reliable solution in operation.

The quick-release system is preferably designed for a protective vest, preferably a tactical bulletproof vest.

The use of the quick-release system according to the invention in a protective vest allows the vest to be dropped instantly during exercises, combat, field and operational activities. For example, when a wearer wearing a protective vest is injured and requires immediate medical attention or when the wearer finds himself in the water. The system according to the invention is at the same time suitable for rapid reassembly to its initial state.

The quick-release system according to the invention can be adapted and applied to other types of clothing and equipment, e.g. military rucksacks, mountaineering rucksacks, avalanche rucksacks and other such rucksacks and items of clothing and specialised equipment designed for quick-release.

The snap buckle according to the invention can be adapted and applied to other types of clothing and specialised equipment, e.g. military rucksacks, mountaineering rucksacks, avalanche rucksacks and other items of clothing and specialised equipment designed for quick-release.

All technical and scientific terms used in the present document have the meaning as commonly understood by a person skilled in the art.

It will be understood by those skilled in the art that the features included in this description and illustrated by the accompanying figures constitute non-limiting embodiments of the present invention, the scope of which is defined by the patent claims. The features illustrated or described in relation to one embodiment may be combined with features from other embodiments to the extent that such features are compatible and not alternative features. The scope of the present invention covers such modifications and variations.

Example embodiments of the invention have been discussed above to outline the principles of construction, function, manufacture and use of the devices and methods disclosed in this description. References used in the description correspond to those shown in the individual figures and in the claims of the patent.

What is claimed is:

1. A quick-unfasten protective vest (1) comprising a quick-release system (2), a front body portion (3) and a rear body portion (4), wherein the front body portion (3) and the rear body portion (4) are detachably connected to each other by the quick-release system (2) comprising a plurality of snap buckles (5) connected by corresponding ties (6) to a central release mechanism (7), wherein each one, of the corresponding ties, (6) is guided from each of the plurality of snap buckles (5), respectively (5) to the central release mechanism (7) so that all ties (6) coincide in the central release mechanism (7), and the central release mechanism (7) is adapted to release the plurality of snap buckles (5) substantially simultaneously and to separate the front body portion (3) from the rear body portion (4) of the vest (1); wherein the central release mechanism (7) comprises first and second parts (8, 9) connected to each other and forming a tie-compression mechanism (10), wherein the first part (8) comprises one first operating part (8*b*) and one first handle (8*a*), and the second part (9) comprises one second operating part (9*b*) and one second handle (9*a*), with a squeeze opening element (11) between the first and second handles, which is adapted to fix an initial position of the first and second parts (8, 9) and to compress and release them with the plurality of snap buckles (5) in the operating position, the first and second operating parts (8*b*, 9*b*) being oppositely arranged and each operating part (8*b*, 9*b*) comprising two tie sockets (12), wherein the tie sockets are arranged so that a tie socket releasing a first shoulder buckle (5*b*) of the plurality of snap buckles (5) is opposite a tie socket releasing a second shoulder buckle (5*b*) of the plurality of snap buckles (5) and is arranged obliquely from a tie socket releasing a first hip buckle (5*a*) of the plurality of snap buckles (5).

2. The quick-unfasten protective vest according to claim 1, wherein the central release mechanism (7) is adapted to substantially simultaneously release all snap buckles (5).

3. The quick-unfasten protective vest according to claim 1, wherein the first and second parts (8, 9) are identical and symmetrically aligned with respect to each other.

4. The quick-unfasten protective vest according to claim 1, wherein the quick-release system (2) comprises four snap buckles (5), including two hip buckles (5*a*) and two shoulder buckles (5*b*).

5. The quick-unfasten protective vest according to claim 1, wherein the quick-release system (2) is concealed under a top layer of the front body portion (3) of the protective vest (1).

6. The quick-unfasten protective vest according to claim 1, wherein each of the plurality of snap buckles (5) is a three-point buckle comprising a male part and a female part detachably connected.

7. The quick-unfasten protective vest according to claim 1, wherein the number of corresponding ties (6) corresponds to the number of the plurality of snap buckles (5), respectively.

8. A quick-release system (2) comprising a plurality of snap buckles (5) connected by corresponding ties (6) to a central release mechanism (7), each one, of the corresponding ties (6) being guided from each snap buckle (5) to the central release mechanism (7) such that all ties (6) coincide in the central release mechanism (7) and the central release mechanism (7) is adapted to release the plurality of snap buckles (5) substantially simultaneously; wherein the central release mechanism (7) comprises first and second parts (8, 9) connected to each other and forming a tie-compression mechanism (10), wherein the first part (8) comprises one first operating part (8*b*) and one first handle (8*a*), and the second part (9) comprises one second operating part (9*b*) and one second handle (9*a*), with a squeeze opening element (11) between the first and second handles, which is adapted to fix a stationary position of the first and second parts (8, 9) and to compress and release them with the plurality of snap buckles (5) in the operating position, the first and second operating parts (8*b*, 9*b*) being oppositely arranged and each operating part (8*b*, 9*b*) comprising two sockets (12) for the ties, wherein the tie sockets are arranged so that a tie socket releasing a first shoulder buckle (5*b*) of the plurality of snap buckles (5) is opposite a tie socket releasing a second shoulder buckle (5*b*) of the plurality of snap buckles (5) and is arranged obliquely from a tie socket releasing a first hip buckle (5*a*) of the plurality of snap buckles (5).

9. The quick-release system according to claim 8, wherein the central release mechanism (7) is adapted to release substantially simultaneously all snap buckles (5).

10. The quick-release system according to claim 8, wherein the first and second parts (8, 9) are identical and symmetrically aligned with respect to each other.

11. The quick-release system according to claim 8, comprising male parts of four snap buckles (5), including male parts of two hip buckles (5*a*) and male parts of two shoulder buckles (5*b*).

12. The quick-release system according to claim 8, wherein the plurality of snap buckles (5) are three-point buckles.

13. The quick-release system according to claim 8, wherein the number of corresponding ties (6) corresponds to the number of the plurality of snap buckles (5), respectively.

* * * * *